US006575704B1

(12) United States Patent
Tiemann

(10) Patent No.: US 6,575,704 B1
(45) Date of Patent: Jun. 10, 2003

(54) TURBOMACHINE AND SEALING ELEMENT FOR A ROTOR THEREOF

(75) Inventor: Peter Tiemann, Witten (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/018,593

(22) PCT Filed: May 24, 2000

(86) PCT No.: PCT/EP00/04736

§ 371 (c)(1),
(2), (4) Date: Dec. 7, 2001

(87) PCT Pub. No.: WO00/75491

PCT Pub. Date: Dec. 14, 2000

(30) Foreign Application Priority Data

Jun. 7, 1999 (EP) ..... 99110871

(51) Int. Cl.[7] ..... H02K 13/00
(52) U.S. Cl. ..... 416/219 R; 416/248; 416/500
(58) Field of Search ..... 416/219 R, 500, 416/248, 96 R, 97 R, 190

(56) References Cited

U.S. PATENT DOCUMENTS 2,801,074 A * 7/1957 Brown
2,930,581 A * 3/1960 Klint
3,076,634 A * 2/1963 Boyle et al.
3,853,425 A 12/1974 Scalzo
4,021,138 A 5/1977 Scalzo et al.
4,455,122 A * 6/1984 Schwarzmann et al. .... 416/190
4,480,957 A * 11/1984 Patel et al. ..... 416/220 R
4,494,909 A * 1/1985 Forestier ..... 416/190
4,725,200 A * 2/1988 Welhoelter ..... 416/221
4,743,166 A 5/1988 Elston
5,052,890 A * 10/1991 Roberts ..... 416/193 A
5,139,389 A 8/1992 Eng
5,823,743 A * 10/1998 Faulkner ..... 416/96 R

FOREIGN PATENT DOCUMENTS

DE 19810567 9/1998
EP 0 799 974 B1 10/1997
EP 0799974 10/1997

* cited by examiner

*Primary Examiner*—Edward K. Look
*Assistant Examiner*—James M McAleenan
(74) *Attorney, Agent, or Firm*—Harness Dickey & Pierce PLC

(57) ABSTRACT

A fluid-flow machine includes a rotor which extends along a rotation axis. The rotor has a rotor-shaft slot having a slot root surface and a moving blade having a blade root. The blade root is inserted into the rotor-shaft slot, and a gap is formed between the blade root and the slot root surface. A sealing element is provided for sealing the gap, which sealing element is at least partly accommodated by the blade root and is movable relative to the blade root. In addition, a sealing element, in particular for a rotor of a fluid-flow machine, preferably includes a first sealing element section and a second sealing element section. The sealing element develops its sealing effect under the effect of an external force, in particular of the centrifugal force.

27 Claims, 8 Drawing Sheets

TURBOMACHINE AND SEALING ELEMENT FOR A ROTOR THEREOF

This application is the national phase under 35 U.S.C. §371 of PCT International Application No. PCT/EP00/04736 which has an International filing date of May 24, 2000, which designated the United States of America, the entire contents of which are hereby incorporated by reference.

FIELD OF THE INVENTION

The invention generally relates to a fluid-flow machine. More preferably, it relates to a fluid flow machine including a rotor which extends along a rotation axis. The rotor preferably includes a rotor-shaft slot and a moving blade having a blade root which is inserted into the rotor-shaft slot, and a gap being formed between the blade root and the slot root surface. The invention also generally relates to a sealing element for a rotor of a fluidflow machine.

BACKGROUND OF THE INVENTION

Rotatable moving blades of fluid-flow machines, for example of gas or steam turbines or compressors, are fastened in different configurations over the full circumference to the circumferential surface of a rotor shaft, which, for example, has a rotatable moving disk. A moving blade in this case normally has a blade body, a blade platform and a blade root having a fastening structure which is accommodated by a rotor-shaft slot configured in a corresponding complementary manner for fixing the moving blade. In this case, the rotorshaft slot may be produced as a circumferential slot or axial slot on the circumferential surface of the rotor shaft. The rotor-shaft slot has a slot root surface.

Due to the design, after the blade root of a moving blade has been inserted into the rotor-shaft slot, a gap is formed by the rotor components adjacent to one another in each case. During operation of the rotor, the gap gives rise to leakage flows of cooling medium or of an action fluid driving the rotor through the gap. Such a gap is formed between the blade root and the slot root surface. A gap of this type may also occur between two adjacent blade platforms of moving blades which are adjacent in the circumferential direction and between the circumferential surface of the rotor shaft and a blade platform radially adjoining the circumferential surface.

In order to limit the possible leakage flows through the gap, such as, for instance, the escape of cooling medium, e.g. cooling air, into the flow passage of a gas turbine, intensive searches are being made for effective sealing concepts. These sealing concepts must be resistant to the temperatures which occur and to the mechanical loading as a result of the considerable centrifugal forces on the rotating system.

DE 198 10 567 A1 discloses a sealing plate for a moving blade of a gas turbine. If cooling air which is fed to the moving blade escapes into the flow passage, this leads, inter alia, to a reduction in the efficiency of the gas turbine. The sealing plate, which is inserted into a gap between the blade platforms of two adjacent moving blades, is intended to prevent the leakage flows resulting from the escape of cooling air. An additional sealing effect is achieved by sealing pins which are likewise fitted between the blade platforms of two adjacent moving blades. A multiplicity of sealing pins are required in order to achieve the desired sealing effect to prevent the escape of cooling air from the adjacent blade platforms.

A sealing concept for a rotor of a gas turbine having a moving disk and a moving blade cooled in the interior is described in U.S. Pat. No. 4,021,138. The moving disk has a front face, a rear face located opposite the front face along the rotation axis, and an axial moving-disk slot which extends from the front face into the rear face. The moving blade has a blade root which is accommodated by the axial moving-disk slot. In the moving disk, a cooling-medium chamber is adjacent to the blade root in a radially inward direction and passes completely through the moving disk in the axial direction from the front face up to the rear face.

Provided in the moving blade are cooling-medium passages which extend from the blade root up to the blade body in the radial direction and are in fluidic connection with the cooling-medium chamber, so that, for the internal cooling of the moving blade, a cooling medium passes from the cooling-medium chamber into the cooling-medium passages. For this purpose, a cooling medium is admitted to the cooling-medium chamber via a cooling-medium feed arranged axially upstream of the front face. In order to seal the cooling-medium chamber against an escape of cooling medium, a first sealing plate is arranged on the front face and a second sealing plate is arranged on the rear face of the moving disk. For improved sealing, that side of the first sealing plate which faces the front face has a passage which extends in the circumferential direction of the moving disk and opens toward the front face.

The passage is defined in the radial direction by an outer marginal region arranged radially outward and by an inner marginal region located opposite the outer marginal region and arranged radially inward, the outer and inner marginal regions adjoining the front face. The outer marginal region is configured in such a way that, as a result, that part of the passage which adjoins the front face is inclined in a direction relative to the normal of the front face, this direction having a radially outward component. A sealing rod which extends in the circumferential direction is inserted into the passage in such a way as to be movable.

During operation of the rotor, the sealing rod, under the effect of centrifugal force, moves radially outward in the passage along the outer marginal region and in a direction toward the front face, where it finally assumes its sealing position. In the sealing position, the sealing rod is in contact with the front face and seals a gap which is formed between the front face and that side of the sealing plate which faces the front face. This is intended to largely prevent cooling medium from escaping through the gap from the cooling-medium chamber or the cooling-medium feed. This solution is very costly due to the use of the relatively extended sealing plates and the additional sealing rods. Furthermore, maintenance and repair work on the moving blade is only possible after complete removal of these sealing components from the rotor.

EP 0 799 974 A2 discloses a sealing element for a moving blade of a turbomachine. In this case, the turbomachine has a rotor with a rotor disk arranged radially inward, a multiplicity of moving blades being fastened radially outward to the rotor disk in the circumferential direction of the rotor disk with a respective gap being formed. To cool the rotor, cooling passages are provided which extend in the radial direction through the rotor disk and the moving blades.

In order to limit an escape of cooling medium (leakage) from the gap in the region of the blade fastening, a sealing element is arranged between the blade root and the rotor disk. The sealing element, under the effect of centrifugal force, performs a tilting movement and thereby reaches its sealing position. In order to secure the sealing element in the direction of the rotation axis in such a way as to prevent it from falling out of the gap, the sealing element has two securing teeth which enclose a projection, formed radially inward, in the blade root, the sealing element, in particular one of the securing teeth, projecting at least partly from the gap at the front face of the rotor disk.

SUMMARY OF THE INVENTION

An object of the invention is to specify a fluid-flow machine including a rotor which has a rotor-shaft slot and a slot root surface and a moving blade with a blade root, the blade root being inserted into the rotor-shaft slot, with a sealing element. Preferably, the sealing element is intended to make it possible to efficiently limit axial leakage flows and is to be as resistant as possible to the mechanical and thermal loads which occur. A further object of the invention is to specify a sealing element, in particular for a rotor of a fluid-flow machine.

According to the invention, the first-mentioned object is achieved, for example, by a fluid-flow machine including a rotor which extends along a rotation axis and has a rotor-shaft slot having a slot root surface and a moving blade having a blade root, the blade root being inserted into the rotor-shaft slot, and a gap being formed between the blade root and the slot root surface. A sealing element is preferably provided for sealing the gap. The sealing element is further preferably at least partly accommodated by the blade root. In addition, the sealing element is preferably movable relative to the blade root, and is in contact with the slot root surface under the effect of centrifugal force and thereby sealing the gap.

During operation of a fluid-flow machine, for example of a gas or steam turbine or of a compressor, the rotor is preferably exposed to an action fluid, e.g. a hot gas, steam or heated air, flowing along this rotor. In the process, an action fluid, as a result of expansion, can preferably perform work on the moving blades and set the latter in rotation about the rotation axis. The rotor having the moving blade can be subjected to both very high thermal and mechanical loading, in particular by the centrifugal forces occurring as a result of the rotation. A cooling medium, e.g. cooling air, is preferably used to cool the rotor and in particular the moving blade, this cooling medium normally being fed to the rotor through suitable cooling-medium feeds. In this case, leakage flows of both cooling medium and flowing action fluid—"gap losses"—may occur in the gap formed by the blade root and the slot root surface. These leakage flows have a very adverse effect on the cooling efficiency and on the mechanical installation strength (smooth running and creep strength) of the moving blade in the rotor-shaft slot.

A new way of effectively sealing the gap against possible leakage flows is preferably provided. This may be achieved, on the one hand, by the sealing element being at least partly accommodated by the blade root and being movable relative to the latter. On the other hand, the centrifugal force occurring during operation of the fluid-flow machine, i.e. during rotation of the rotor, may be deliberately utilized for sealing purposes. In addition to the fastening of the moving blade, the blade root therefore can serve at the same time to accommodate the sealing element.

Furthermore, the sealing element is preferably guided in the blade root by the configuration specified. The gap extends in the radial direction and axial direction and also in the circumferential direction of the rotor, the axial extent of the gap normally being predominant, and the extent of the gap in the circumferential direction being greater than the radial dimension. The precise geometry of the gap is determined by the specific configuration of the rotor-shaft slot and of the slot root surface and also of the blade root. In this case, the sealing element may be adapted individually to the respective geometry of the rotor and to the requirements with regard to the leakage flows to be limited.

According to the invention, the sealing element preferably seals the gap under the effect of centrifugal force. During operation of the fluid-flow machine, the sealing element, as a result of the rotation, is then brought into its sealing position by the centrifugal force directed radially outward and develops its sealing effect. In the process, the sealing element is firmly pressed against the slot root surface and seals the gap.

A considerable advantage compared with conventional sealing concepts can be obtained due to the specific sealing of the gap, for example. In this way, it is possible to realize a very compact type of construction. Extended sealing elements, which are very costly, are therefore unnecessary. The sealing element is arranged locally where it is required for efficiently limiting leakage flows.

During operation of the rotor, the sealing element preferably reaches its sealing position in the process and develops its sealing effect. In this case, the sealing element comes into contact with the slot root surface and is pressed firmly against the slot root surface. Furthermore, owing to the fact that the sealing element is at least partly accommodated by the blade root, the gap is sealed.

In this way, for example, the ingress of an action fluid, e.g. of the hot gas in a gas turbine, into the gap is effectively prevented. This protects the material of the rotor, in particular the material of the blade root, from the high temperatures and the possible oxidizing and corrosive influences of the action fluid. Owing to the fact that leakage flows of action fluid and/or cooling medium in the gap are prevented by the sealing element, temperature gradients in the region of the blade fastening are avoided. Possible thermal stresses which result from an impaired thermal expansion of adjacent rotor components during temperature differences are thereby reduced. The blade root of a moving blade and the rotor-shaft slot which accommodates and fixes the moving blade may therefore be produced with a markedly smaller tolerance. A smaller tolerance dimension has an advantageous effect on the mechanical installation strength of the moving blade and on the smooth running of the rotor.

In particular, fits which are preferably provided for fastening the blade root in the rotor-shaft slot may be provided with a smaller clearance. This also correspondingly reduces the possible leakage flows through the fit. Since the sealing element is at least partly accommodated by the blade root, it is securely held and secured against falling out of the rotor, on the one hand, and is protected from being directly acted upon by the action fluid, on the other hand. In this case, the sealing element is not necessarily firmly coupled to a moving blade, in particular to the moving-blade root. This facilitates assembly and repair work on a moving blade, such as, for example, the exchange of a moving blade, without a relatively large effort. The sealing element remains largely unaffected by this and can therefore also be used repeatedly.

The rotor preferably has a moving disk which includes the rotor-shaft slot with the slot root surface, the rotor-shaft slot extending along a transverse axis which is inclined relative to a plane perpendicular to the rotation axis. The fastening of the rotatable moving blade in the rotor-shaft slot is thus produced in such a way that, during operation of the rotor, it can absorb, with a high degree of certainty, the blade stresses caused by flow and centrifugal forces and by blade vibrations and can transmit the forces which occur to the moving disk and finally to the entire rotor. The fastening of the moving blade may be effected, for example, by axial slots, a moving blade being secured in position in a moving-disk slot provided specially for this and extending essentially in the axial direction. For low stresses, e.g. in the case of moving blades in axial-flow compressors, simple fastenings of the moving blade, for example with a dovetail or Laval root, are possible. For steam-turbine end stages having long moving blades and correspondingly large blade centrifugal forces, in addition to the "push-in root", the axial fir-tree root is also suitable. The axial fir-tree fastening is preferably also used in thermally highly loaded moving blades in gas turbines. In this case, the rotor-shaft slot may extend entirely across the entire moving disk along the transverse axis. The gap between the slot root surface and the blade root is then open radially and accordingly extends along the transverse axis.

The sealing element is preferably arranged in a recess, in particular in a slot, in the blade root. The sealing element is secured against falling out and/or against being thrown out by the effect of centrifugal force during steady-state operation or during transient loading of the rotor by the sealing element being arranged in a suitable recess in the blade root. In addition, a reaction surface is produced in the blade root by the recess, this reaction surface expediently being designed as a sectional surface of the recess. In the case of a slot, this reaction surface is produced, for example, on the slot root. The reaction surface is then arranged radially outward in the blade root and is located opposite the slot root surface of the rotor-shaft slot in the radial direction.

To achieve as good a sealing effect as possible during the engagement of the sealing element in the recess, the reaction surface may be produced with correspondingly small and well-defined surface roughness. After the actual production of the recess, in particular of the slot, for example by stock removal from the blade root by means of a milling or turning operation, a reaction surface having the desired roughness can be produced on the slot root by polishing.

The blade root preferably has a first blade-root margin and a second blade-root margin, located opposite the first blade-root margin along the rotation axis, and a blade-root center region which is arranged axially between the first blade-root margin and the second blade-root margin, a sealing element being arranged in the region of the first blade-root margin and/or of the second blade-root margin and/or of the blade-root center region. In this case, for example, relative to the direction of flow of a flowing action fluid, for example of a hot gas of a gas turbine, the first blade-root margin 47 is arranged upstream and the second blade-root margin 51 is arranged downstream. Depending on the design conditions and requirements with regard to the sealing effect to be achieved in the gap, this geometrical division permits a configuration and arrangement of the sealing element or of a plurality of sealing elements in various sections of the blade root.

The arrangement of a sealing element in the region of the first blade-root margin arranged upstream primarily limits the ingress of flowing, possibly very hot, action fluid into the gap and therefore prevents damage to the rotor. The arrangement of the sealing element in the region of the second blade-root margin arranged downstream mainly serves to limit the escape of cooling medium, e.g. cooling air under a certain pressure in the gap, upstream in the axial direction along the slot root surface into the flow passage. Since the action fluid expands in the flow direction, the pressure of the action fluid is continuously reduced in the flow direction. A cooling medium under a certain pressure in the gap will therefore escape from the gap in the direction of the lower ambient pressure, that is to say at the second blade-root margin arranged downstream. For this reason, it is advantageous to provide a sealing element in the region of the second blade-root margin. The blade-root center region forms a further section of the blade root. Together with the first and the second blade-root margin, there are therefore different possibilities available for arranging a sealing element in various sections of the blade root. In this case, in moving blades which have an internal cooling system, a cooling medium, e.g. cooling air, being fed by a suitable cooling-medium feed which is arranged in the blade-root center region, the sealing element will preferably be arranged in the region of the first or the second blade-root margin. In moving blades without such an internal cooling system, the sealing element may be arranged just as advantageously in the region of the blade-root center region.

A plurality of sealing elements are preferably provided. The number and arrangement of the sealing elements is determined depending on the design conditions and requirements with regard to the sealing effect to be achieved, it also being possible for combinations of several sealing elements to be used. The sealing concept offers very high flexibility with regard to the adaptation to an actual task definition. For example, the combination of a sealing element in the region of the first blade-root margin and a further sealing element in the region of the second blade-root margin seals the gap from two sides and therefore provides a high degree of safety both against an ingress of action fluid into the gap and against an escape of cooling medium from the gap into the flow passage of the fluid-flow machine. An escape of cooling medium into the flow passage would lead, inter alia, to a reduction in the efficiency of the fluid-flow machine. A multiple arrangement of sealing elements is also very advantageous in this respect.

The sealing element preferably extends in a plane perpendicular to the rotation axis. The gap has a radial extent and an axial extent and also an extent in the circumferential direction of the rotor. A sealing element extending in a plane perpendicular to the rotation axis is therefore especially suitable for obstructing possible axial leakage flows in a highly efficient manner. Thus, for example, an axial leakage flow directed upstream, e.g. a hot gas from the flow passage of a gas turbine, this leakage flow spreading along the slot root surface, is effectively obstructed by the sealing element. In the process, the leakage flow is retarded in the gap by the obstacle in the form of the sealing element and finally comes to a stop on that side of the sealing element facing the leakage flow (single choke). That side of the sealing element which faces away from the leakage flow and the adjoining part of the gap in the axial direction are already protected by the single sealing element from being acted upon by the leakage medium, e.g. a hot action fluid or a cooling medium. A marked improvement in this single solution with an individual sealing element which extends in a plane perpendicular to the rotation axis is obtained by the combination of the sealing element with one or more further sealing elements which likewise extend in a plane perpendicular to the rotation axis and which are arranged at an axial distance from the sealing element. Possible leakage flows in the gap are considerably reduced by this multiple arrangement of sealing elements.

The sealing element is preferably movable in the radial direction. This achieves the effect that the sealing element moves away from the rotation axis of the rotor in the radial direction under the effect of centrifugal force. This effect is deliberately utilized in order to achieve. a markedly improved sealing effect in the gap. In the process, the sealing element, under the effect of centrifugal force, comes into contact with a reaction surface which is arranged radially outward and is configured, for example, as a sectional surface of a recess, in particular of a slot. The sealing element is pressed firmly against the reaction surface. Appropriately advantageous utilization of the centrifugal force and of the reaction forces and their force components at the reaction surface achieves the effect that the sealing element at the same time comes into contact with the slot root surface and is pressed firmaly against the slot root surface. Sufficient radial mobility of the sealing element is ensured by suitable dimensioning of the recess, in particular of the slot, in the blade root and of the sealing element.

Furthermore, it is advantageous that, as a result, the sealing element, for any possible maintenance purposes or in the event of a failure of the moving blade, can be removed from the recess without any problems and if need be exchanged without additional tools and without the risk of caking of the sealing element on account of an oxidizing or corrosive attack at high operating temperatures. In addition, a certain tolerance of the sealing element, which engages in the recess, in particular in the slot, in the blade root, is very useful, since thermal expansions are thereby permitted and consequently thermally induced stresses between the sealing element and the adjoining slot root surface and the blade root are avoided.

The sealing element preferably has a first sealing element section and a second sealing element section which are movable relative to one another. In this case, the sealing element sections may be configured in such a way that, in a special manner, they perform a partial sealing function for different regions in the gap which are to be sealed, in particular for different regions of the slot root surface. The sealing element sections, by their paired arrangement, then complement one another to form one sealing element, the sealing effect of the paired system consisting of sealing element sections being greater than that of a single sealing element section.

A configuration of the sealing element sections which is especially adapted to the regions in the gap which are to be sealed in each case makes it possible for the sealing effect of the paired arrangement to be greater than would be realizable with a one-piece sealing element. An especially flexible and efficient system of sealing element sections is therefore provided by the relative mobility of the sealing element sections. In this case, both relative translations and rotations of the sealing element sections relative to one another are envisaged. Provided the sealing element sections extend, for example, in a plane perpendicular to the rotation axis, the relative movements are restricted essentially in this plane. The relative mobility of the sealing element sections permits a highly adapted system, which is configured according to the thermal and/or mechanical loading of the rotor and according to the specific geometry of the gap to be sealed. In this case, the adapted system of sealing element sections is configured and mounted in such a way that it adjusts itself, as it were, under the effect of the external forces, such as, for example, the centrifugal force and the normal or bearing forces (reaction forces), and develops its sealing effect in the process. Furthermore, the movable pair of sealing element sections advantageously compensates for possible thermally or mechanically induced stresses in a markedly better manner than in the case of conventional sealing concepts.

A first rotary region having a first rotary axis is advantageously assigned to the first sealing element section, and a second rotary region having a second rotary axis is advantageously assigned to the second sealing element section.

Each of the sealing element sections is therefore preferably designed in such a way that it mounted so as to be rotatable about a respective rotary axis. If the sealing elements extend in a plane perpendicular to the rotation axis, the rotation of the sealing element sections is restricted in this plane. Improved sealing of the gap is made possible as a result, since each sealing element section is brought into a favorable sealing position by the rotation. In this way, an improved sealing effect is independently achieved for each sealing element section. In this case, the rotary axis of a sealing element section may also be formed as a supporting point (supporting axis) of the rotary region with a suitable supporting surface, e.g. with a reaction surface which adjoins the rotary region. The reaction surface is advantageously produced as a sectional surface of a recess, in particular of a slot, in the blade root. In this case, the first rotary axis and the second rotary axis may be different from one another or identical. In the latter case, the first sealing element section and the second sealing element section have a common rotary axis.

The mass center of the first sealing element section is preferably arranged relative to the first rotary axis and the mass center of the second sealing element section is preferably arranged relative to the second rotary axis in such a way that the torques resulting under the effect of centrifugal force are opposed. Due to the resulting opposed torques, the sealing element sections are rotated relative to one another in an opposite direction about the respective rotary axis. The centrifugal force acts radially outward in the same way for both sealing element sections and acts at the respective mass center. Here, the perpendicular connecting vector from the mass center of one of the sealing element sections to the associated rotary axis, together with the centrifugal-force vector, forms, for example, a right-handed system. In this case, the perpendicular connecting vector from the mass center of the other sealing element section to the rotary axis assigned to the other sealing element section, together with the centrifugal-force vector, forms a left-handed system, so that the resulting torques are opposed. This is ensured by appropriate design of the sealing element sections with regard to the mass distribution, in particular the position of the respective mass center and the mounting of the sealing element sections with regard to the rotary axis.

The first sealing element section and the second sealing element section preferably have similar geometry. The sealing element sections may therefore be transformed into one another by rotations or mirror inversions or symmetry operations combined therefrom. This is an especially favorable solution from the production point of view, especially if the first sealing element section and the second sealing element section are of identical design. It is then only necessary to produce one form of the sealing element section, which is produced, for example, from one workpiece by a turning or milling operation or as a casting by means of a suitable casting mold. A first sealing element section and a further identical second sealing element section may thus be arranged as a pair in a simple manner to form a sealing element, a factor which is very cost-effective.

A further improved sealing effect in the gap may be achieved by virtue of the fact that, in a preferred configuration, the first sealing element section and the second sealing element section overlap in the circumferential direction. A possible axial leakage flow is effectively obstructed by the overlapping in the circumferential direction. In this case, the first sealing element section and the second sealing element section may each have a slot-root sealing edge adjoining the slot root surface and a rotary edge located opposite the slot-root sealing edge in the radial direction, the rotary edge comprising the rotary region. During operation of the rotor, i.e. under the effect of centrifugal force, the slot-root sealing edge of the first sealing element section and the slot-root sealing edge of the second sealing element section in each case come into contact with the slot root surface and seal the gap. In this case, the system of sealing element sections is configured in such a way that sealing of the gap, in particular in the axial direction, is achieved by the overlapping of the sealing element sections in the circumferential direction, the sealing element sections advantageously complementing one another in their sealing effect.

The first sealing element section and the second sealing element section are preferably arranged axially adjacent to one another. In this case, the sealing element sections may also adjoin one another, a mutually mechanically stabilizing system of sealing element sections being provided for. This helps the sealing element sections to slide along one another in order to reach their precise respective sealing position during operation of the rotor. In this case, the specified system of sealing element sections is designed in such an adapted manner that it adjusts itself under the effect of the external forces, such as, for example, the centrifugal force and the normal and bearing forces, in order to achieve the desired sealing effect in the gap. Here, in the paired arrangement of the two sealing element sections to form a sealing element, especially good positive locking in the gap, in particular at the slot root surface, is realized.

The sealing element is preferably made of a high-temperature-resistant material, in particular a nickel-base or cobalt-base alloy. In addition, these alloys also have sufficient elastic deformation properties. The material of the sealing element is preferably selected so as to match the material of the rotor, as a result of which impurities or diffusion damage are largely avoided. Furthermore, a uniform thermal expansion or contraction of the rotor is ensured with the sealing element.

The fluid-flow machine is preferably a gas turbine.

An object which relates to a sealing element for a rotor of a fluid-flow machine may be achieved according to the invention by a sealing element, in particular for a rotor of a fluid-flow machine, which has a first sealing element section and a second sealing element section which are movable relative to one another, and a first rotary region having a first rotary axis is assigned to the first sealing element section, and a second rotary region having a second rotary axis is assigned to the second sealing element section, the mass center of the first sealing element section being arranged relative to the first rotary axis and the mass center of the second sealing element section being arranged relative to the second rotary axis in such a way that the torques resulting on both sealing element sections under an effect of a force are opposed. In this case, the effect of a force on both sealing element sections, for example in a rotating system, may be caused by the centrifugal force. In a fluid-flow machine, e.g. a gas or steam turbine or a compressor, including a rotor which extends along a rotation axis and has a rotor-shaft slot having a slot root surface and a moving blade having a blade root, the blade root being inserted into the rotor-shaft slot, the sealing element is especially suitable for sealing a gap formed between the blade root and the slot root surface. In this case, the gap is sealed off from possible leakage flows, for example of an action fluid or a cooling medium. However, the sealing element may also be used in other rotating systems in which a fluid flow, in particular a leakage flow, is to be sealed. Possible applications of the sealing element are, for example, in rotors or impellers of prime movers or driving machines which have hydraulic and/or pneumatic systems containing a fluid, e.g. an operating medium or lubricant (oil), and in internal combustion engines or aircraft engines containing an operating medium.

The first sealing element section and the second sealing element section preferably have similar geometry. By symmetry operations such as rotation or mirror inversion or combinations of rotation and mirror inversion, the first sealing element section and the second sealing element section may therefore be transformed into one another. An especially advantageous configuration includes the first sealing element section being and the second sealing element section being components which are identical from the design point of view. In this way, only one component needs to be produced, this component being produced, for example, as a casting by means of a casting mold or by a turning or milling operation.

BRIEF DESCRIPTION OF THE DRAWINGS

The invention, by way of example, is explained below in more detail with reference to the exemplary embodiments shown in the drawing, in which, in a partly schematic and simplified manner.

The same reference numerals have the same meaning in the individual figures.

DETAILED DESCRIPTION OF THE PREFERRED EMBODIMENTS

Figure 1:
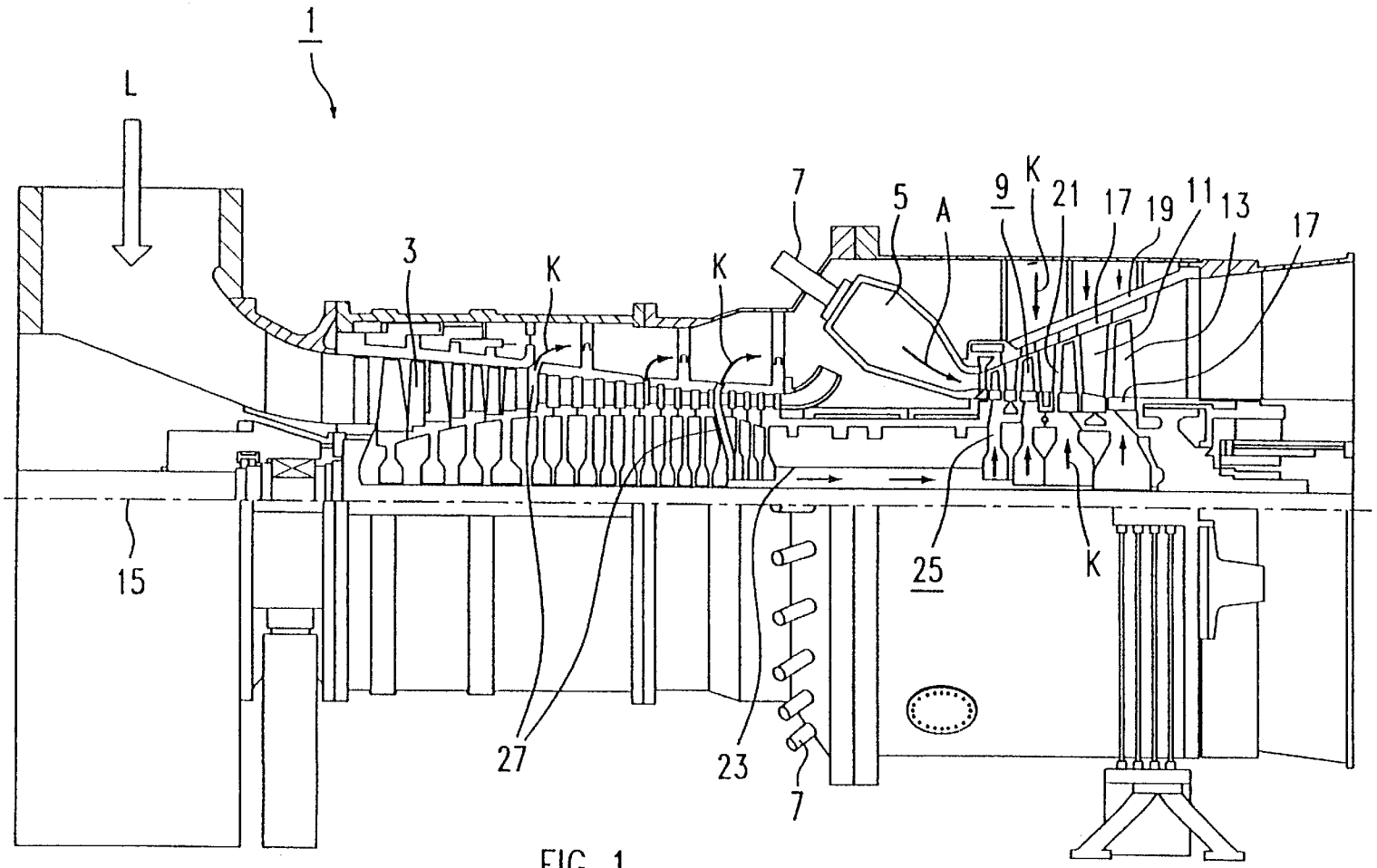
FIG. 1 shows a half section through a gas turbine with compressor, combustion chamber and turbine.

A half section through a gas turbine 1 is shown in FIG. 1. The gas turbine 1 has a compressor 3 for combustion air, a combustion chamber 5 with burners 7 for a liquid or gaseous fuel, and a turbine 9 for driving the compressor 3 and a generator (not shown in FIG. 1). In the turbine 9, fixed guide blades 11 and rotatable moving blades 13 are arranged along the rotation axis 15 of the gas turbine 1 on respective radially extending rings (not shown in the half section). In this case, a pair including a ring of guide blades 11 (guide-blade ring)

and a ring of moving blades 13 (moving-blade ring), following one another along the rotation axis 15, are designated as turbine stage.

Each guide blade 11 has a blade platform 17 which is arranged on the inner turbine casing 19 in order to fix the relevant guide blade 11. In this case, the blade platform 17 constitutes a wall element in the turbine 9. The blade platform 17 forms an outer boundary of the flow passage 21, through which a hot action fluid A flows during operation of the turbine 9. The moving blade 13 is fastened via a corresponding blade platform 17 to the turbine rotor shaft 23, which is arranged along the rotation axis 15 of the gas turbine 1. In this case, the turbine rotor shaft 23 may be assembled, for example, from a plurality of moving disks (not shown in FIG. 1) which accommodate the moving blades 13, are held together by a tie rod (not shown) and are centered with respect to the rotation axis 15 by means of serrations in such a way as to tolerate thermal expansion. The turbine rotor shaft 23 together with the moving blades 13 forms the rotor 25 of the fluid-flow machine 1, in particular of the gas turbine 1.

During operation of the gas turbine, air L is drawn in from the environment. The air L is compressed in the compressor 3 and thus preheated at the same time. In the combustion chamber 5, the air L is brought together with the liquid or gaseous fuel and burned, as a result of which a hot action fluid A is produced. A portion of the air L bled beforehand from the compressor 3 from suitable bleed points 27 serves as cooling air K for cooling the turbine stages, the first turbine stage, for example, being acted upon by a turbine inlet temperature of about 750° C. to 1200° C. Expansion and cooling of the hot action fluid A, designated below as hot gas A, are effected in the turbine 9, this hot gas A flowing through the turbine stages and setting the rotor 25 in rotation in the process. For the internal cooling of the moving blade 13, the cooling air K is fed via the turbine rotor shaft 23 to the moving blade 13 through suitable supply lines (not shown). In this case, the cooling air K flows from the bleed point 27 in the compressor 3 first of all upstream in the turbine rotor shaft 23 along the rotation axis 15 and is then directed radially outward through the rotor 25 and finally reaches the moving blade 13 in order to cool the latter. Such an internal cooling system for a moving blade 13 is used in particular in the case of thermally highly loaded rotors 25 for the efficient cooling of the blades.

Figure 2:
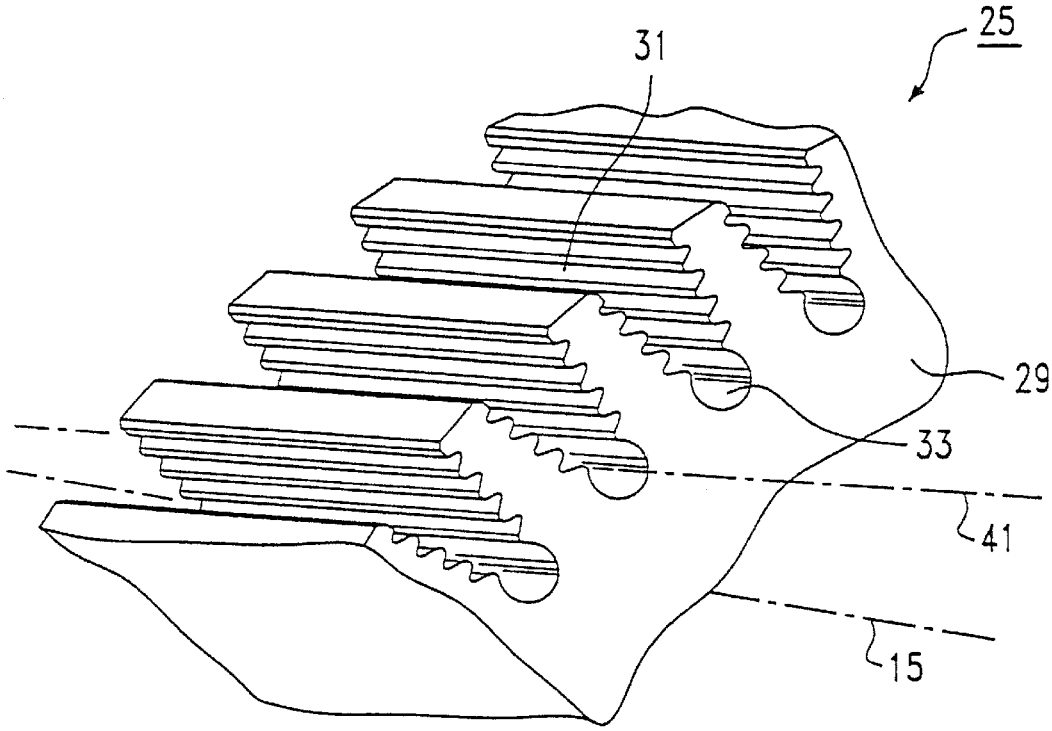
FIG. 2 shows a perspective view of a detail of a moving disk of a rotor.

FIG. 2 shows a perspective view of a detail of a moving disk 29 of a rotor 25. The moving disk 29 is centered along the rotation axis 15 of the rotor 25. The moving disk 29 has a rotor-shaft slot 31 for fastening a moving blade 13 of the gas turbine 1. The rotor-shaft slot 31 extends along a transverse axis 41 which is inclined relative to a plane perpendicular to the rotation axis 15. In this case, the transverse axis 41 forms an angle with the rotation axis 15 differing from 0°. However, the transverse axis 41 may also be parallel to the rotation axis 15. The rotor-shaft slot 31 has a slot root surface 33 which is arranged at the slot root of the rotor-shaft slot 31 and extends along the transverse axis 41. The rotor-shaft slot 31 is configured as an axial moving-disk slot, in particular as an axial fir-tree slot. In this way, reliable fastening of a moving blade 13 is possible, in which case, during operation of the fluid-flow machine 1, the blade stresses caused by flow forces and centrifugal forces and also by blade vibrations can be absorbed with a high degree of certainty and good transmission of the forces which occur to the moving disk 29 and finally to the entire rotor 25 is ensured.

Figure 3:
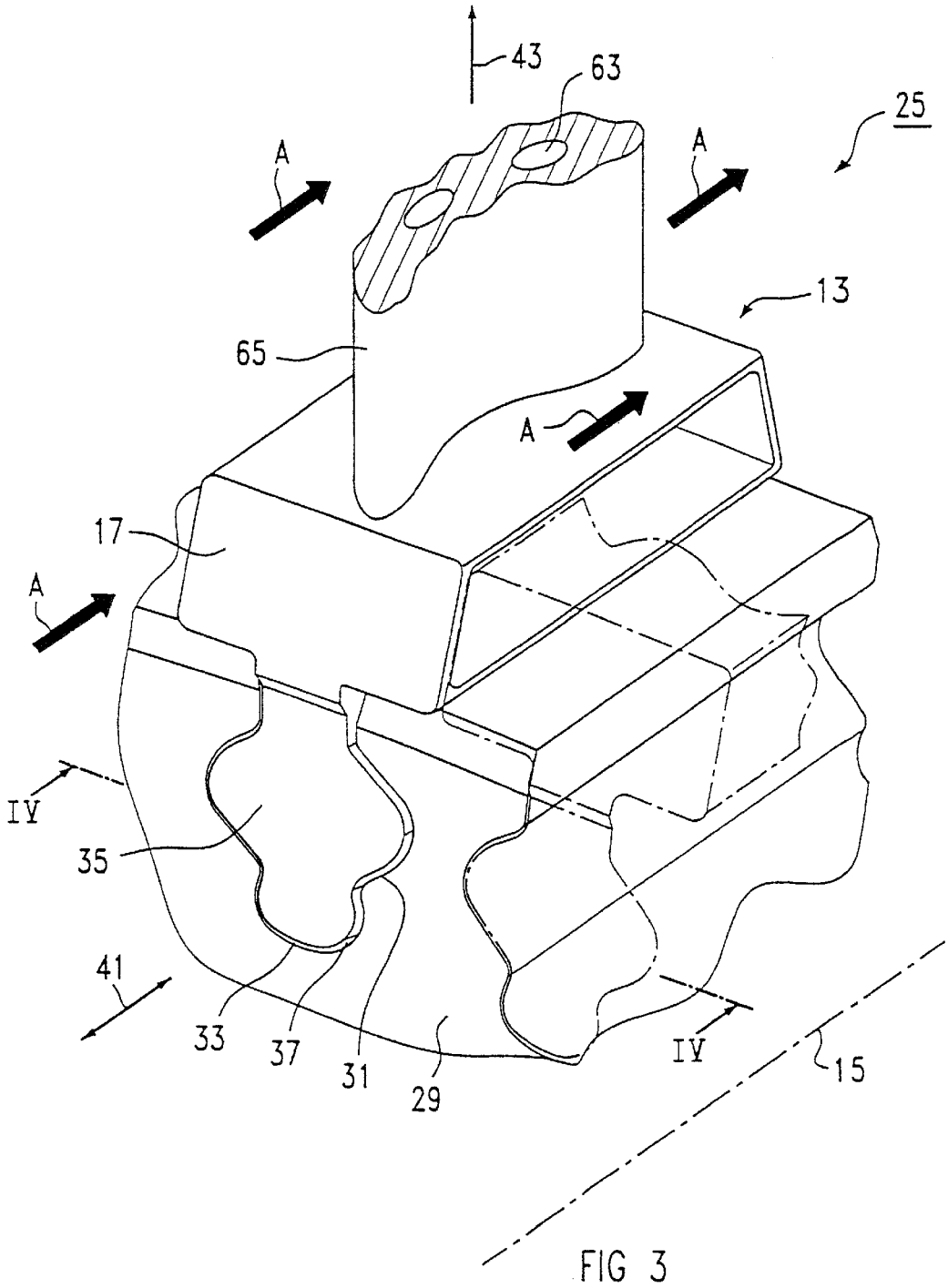
FIG. 3 shows a perspective view of a detail of a moving disk with inserted moving blade.

A perspective view of a detail of a rotor 25 is shown in FIG. 3. The rotor 25 has a moving disk 29 and a moving blade 13. The moving disk 29 has a rotor-shaft slot 31 with a slot root surface 33. The moving blade 13 extends along a longitudinal axis 43 directed radially outward and comprises a blade root 35, a blade platform 17 adjoining the blade root, and a blade body 65 (only partly shown), which follow one another along the longitudinal axis 43. The moving blade 13 is inserted with its blade root 35 into the rotor-shaft slot 31 in the insertion direction 41 of the moving-disk slot 31. A gap 37 which extends in the insertion direction 41 is formed between the blade root 35 and the slot root surface 33. A hot gas A flowing past the blade body 65 produces a torque on the moving disk 29. At high operating temperatures of the rotor 25, the blade body 65 of the moving blade 13 requires internal cooling, the supply lines 63 of which extend in the blade body 65 along the longitudinal axis 43 of the moving blade 13. The supply lines 63 are part of an internal cooling system, which is not shown in any more detail. In this case, a cooling medium K, for example cooling air K, is directed by a feed line (not shown) through the moving disk 29 into the blade root 35 of the moving blade 13 and from there via the supply line 63 into the blade body 65. In order to prevent an escape of cooling medium K, in particular cooling air K, from the gap 37 and to limit the ingress of the hot gas A into the gap 37, the gap 37 is sealed (see FIG. 4).

Figure 4:
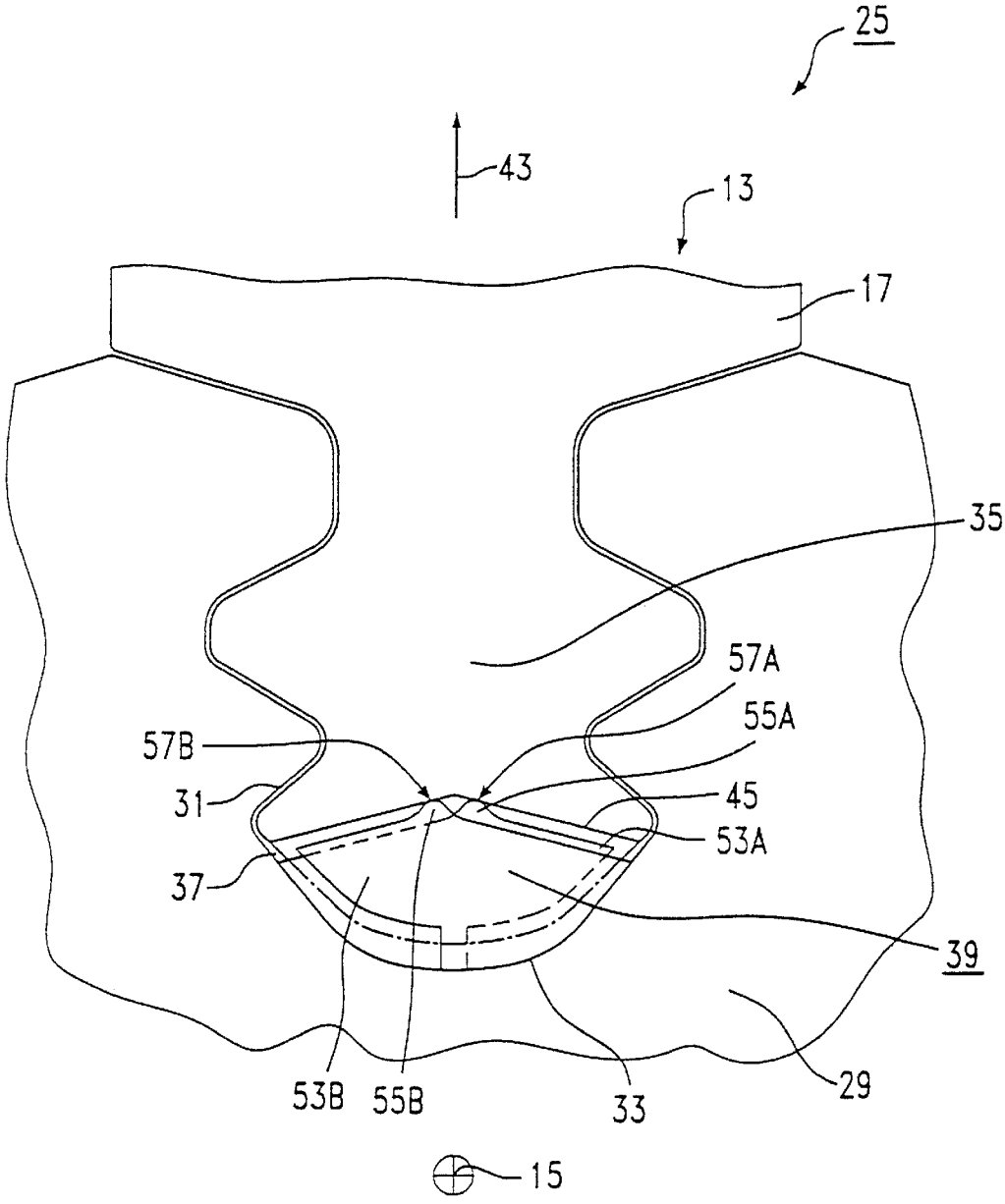
FIG. 4 shows a detail of a view of the arrangement shown in FIG. 3 along section line IV—IV with a sealing element.

FIG. 4 shows a detail of a view of the arrangement shown in FIG. 3 along section line IV—IV with a sealing element 39. The sealing element 39 is provided for sealing the gap 37. The sealing element 39 extends in a plane perpendicular to the rotation axis 15 and is arranged in a recess 45, in particular in a slot, in the blade root 35 and in the process is partly accommodated by the blade root 35. The sealing element 39 has a first sealing element section 53A and a second sealing element section 53B which are movable relative to one another. The first sealing element section 53A and the second sealing element section 53B overlap in the circumferential direction and are arranged adjacent to one another along the rotation axis 15. A first rotary region 55A having a first rotary axis 57A is assigned to the first sealing element section 53A, and a second rotary region S5B having a second rotary axis 57B is assigned to the second sealing element section 53B.

In this case, the rotary axes 57A, 57B are fixed by the respective supporting point (supporting axis) of the rotary regions 55A, 55B on the slot root of the recess 45, the slot root adjoining the rotary regions 55A, 55B radially outward along the longitudinal axis 43. The rotary axes 57A, 57B are different axes and extend essentially parallel to the rotation axis 15. As a result, a rotation of the sealing element sections 53A, 53B about the respective rotary axis 57A, 57B is made possible. By their configuration and arrangement, the sealing element sections 53A, 53B can each perform both rotations and translations or combinations of rotations and translations.

During operation of the rotor 25, the sealing element 39 seals the gap 37 under the effect of centrifugal force. In the process, each of the sealing element sections 53A, 53B, as a result of the centrifugal force directed radially outward along the longitudinal axis 43, is brought into its sealing position and develops its sealing effect. In this case, each sealing element section 53A, 53B is pressed firmly against the slot root surface 33 and seals the gap 37. The sealing effect is achieved by each sealing element section 53A, 53B performing a rotation about the respective rotary axis 57A, 57B under the effect of centrifugal force until positive-locking contact between the sealing element sections 53A, 53B and the slot root surface 33 is produced. The relative mobility of the sealing element sections 53A, 53B results in a system which is adapted to the gap geometry and is produced as a function of the thermal and/or mechanical loading of the rotor 25 and the design of the gap 37 to be sealed.

The system including sealing element sections 53A, 53B movable relative to one another is configured in such a way that it adjusts itself, as it were, under the effect of the external forces, such as, for example, the centrifugal force and the normal or bearing forces (reaction forces), and assumes its sealing position in the process. The sealing element sections 53A, 53B are configured in such a way and are mounted in the recess 45 in such a way that, under the effect of centrifugal force, the torque on the first sealing element section 53A is opposed to the torque on the second sealing element section 53B. As a result, the sealing element sections 53A, 53B in each case perform a rotation in an opposed direction until they reach their sealing position.

The sealing element sections 53A, 53B are moved relative to one another in a scissors form by these opposed rotations of the sealing element sections 53A, 53B, as a result of which especially reliable retention of the sealing element 39 in the sealing position is ensured. The sealing element 39, comprising the paired sealing element sections 53A, 53B, seals the gap 37 at the slot root surface 33 against the centrifugal force directed in the direction of the longitudinal axis 43. Especially advantageous and efficient sealing of the gap 37 is therefore achieved by the sealing element 39. In addition, by use of the movable pair of sealing element sections 53A, 53B, which are arranged in pairs to form the sealing element 39, possible thermally or mechanically induced stresses are compensated for in a markedly more effective manner than in conventional seals.

Figure 5:
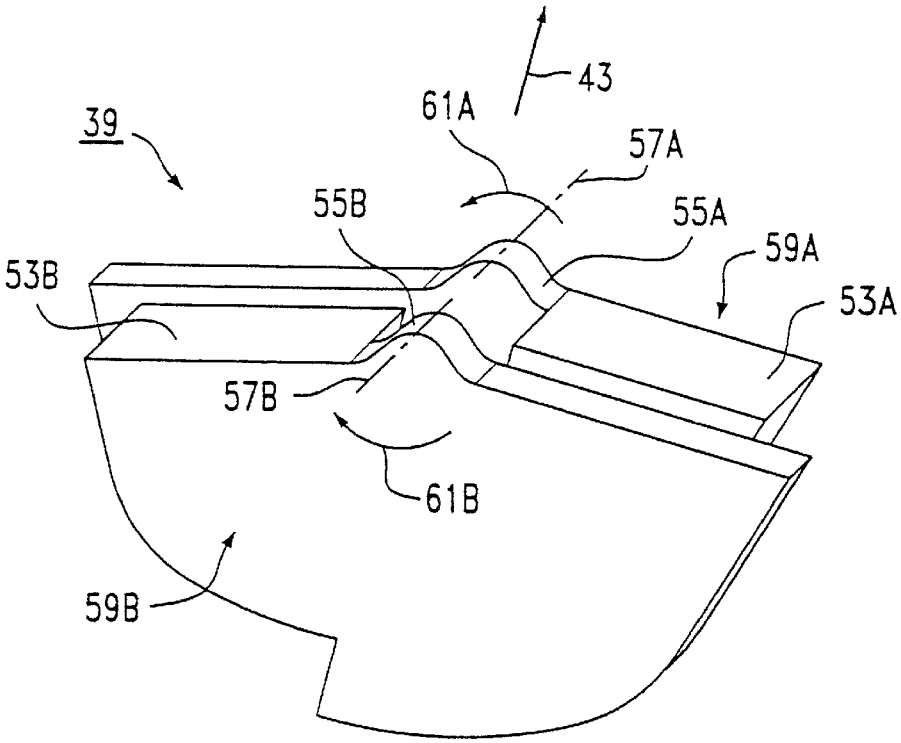
FIG. 5 shows a perspective representation of a sealing element with a first sealing element section and a second sealing element section.

A preferred configuration of the sealing element 39 shown in FIG. 4 is shown in FIG. 5. FIG. 5 shows a perspective representation of a sealing element 39 having a first sealing element section 53A and a second sealing element section 53B. Here, the mass center 59A of the first sealing element section 53A is arranged relative to the first rotary axis 57A and the mass center 59B of the second sealing element section 53B is arranged relative to the second rotary axis 57B in such a way that the torques 61A, 61B resulting under the effect of the centrifugal force directed radially outward along the longitudinal axis 43 are opposed. In this case, the first sealing element section 53A and the second sealing element section 53B have similar geometry, which is especially advantageous from the manufacturing point of view.

Figure 6:
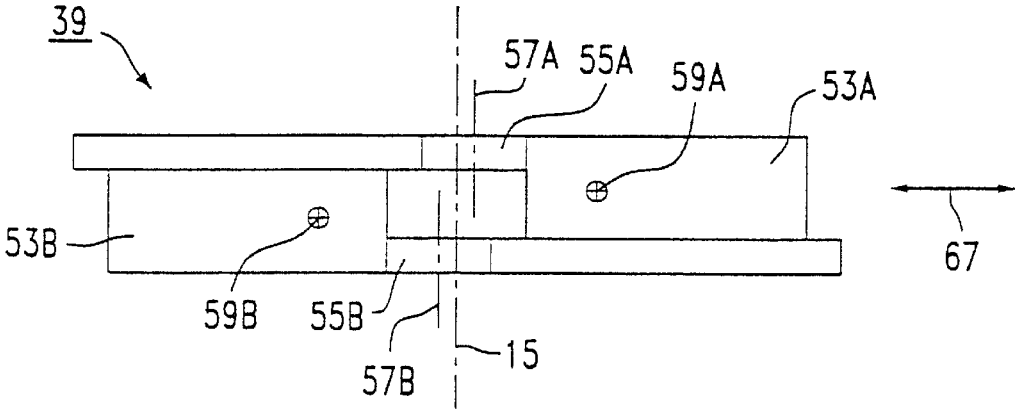
FIG. 6 shows a plan view of the first sealing element section and the second sealing element section perpendicularly to the rotation axis.

FIG. 6 shows a plan view of the first sealing element section 53A and the second sealing element section 53B according to FIG. 5 perpendicularly to the rotation axis, that is against the longitudinal axis 43. Relative to the rotation axis 15, the mass center 59A of the first sealing element section 53A, in the circumferential direction 67, is located opposite the mass center 59B of the second sealing element section 53B. The same applies to the rotary axes 57A, 57B assigned to the sealing element sections 53A, 53B, so that the torques resulting under the effect of force on both sealing element sections 53A, 53B are opposed. The two sealing element sections 53A, 53B are movable relative to one another, for example in the circumferential direction 67. As a result, in the fitted state of the sealing element 39 (compare FIG. 4), the gap 37 is effectively sealed under the effect of centrifugal force, the sealing element sections 53A, 53B reaching their respective sealing position after performing a restricted relative translation and rotation. In the process, the sealing element sections 53A, 53B complement one another in their sealing effect, so that, in particular, leakage flows along the rotation axis 15 are limited in a very efficient manner. When the sealing element 39 is used for a rotor 25 of a fluid-flow machine 1, for example of a gas turbine 1, the material selected for the sealing element 39 is a high-temperature-resistant material which, in addition, has sufficient elastic deformation properties. Nickel-base or cobalt-base alloys, for example, are suitable for this.

Figure 7:
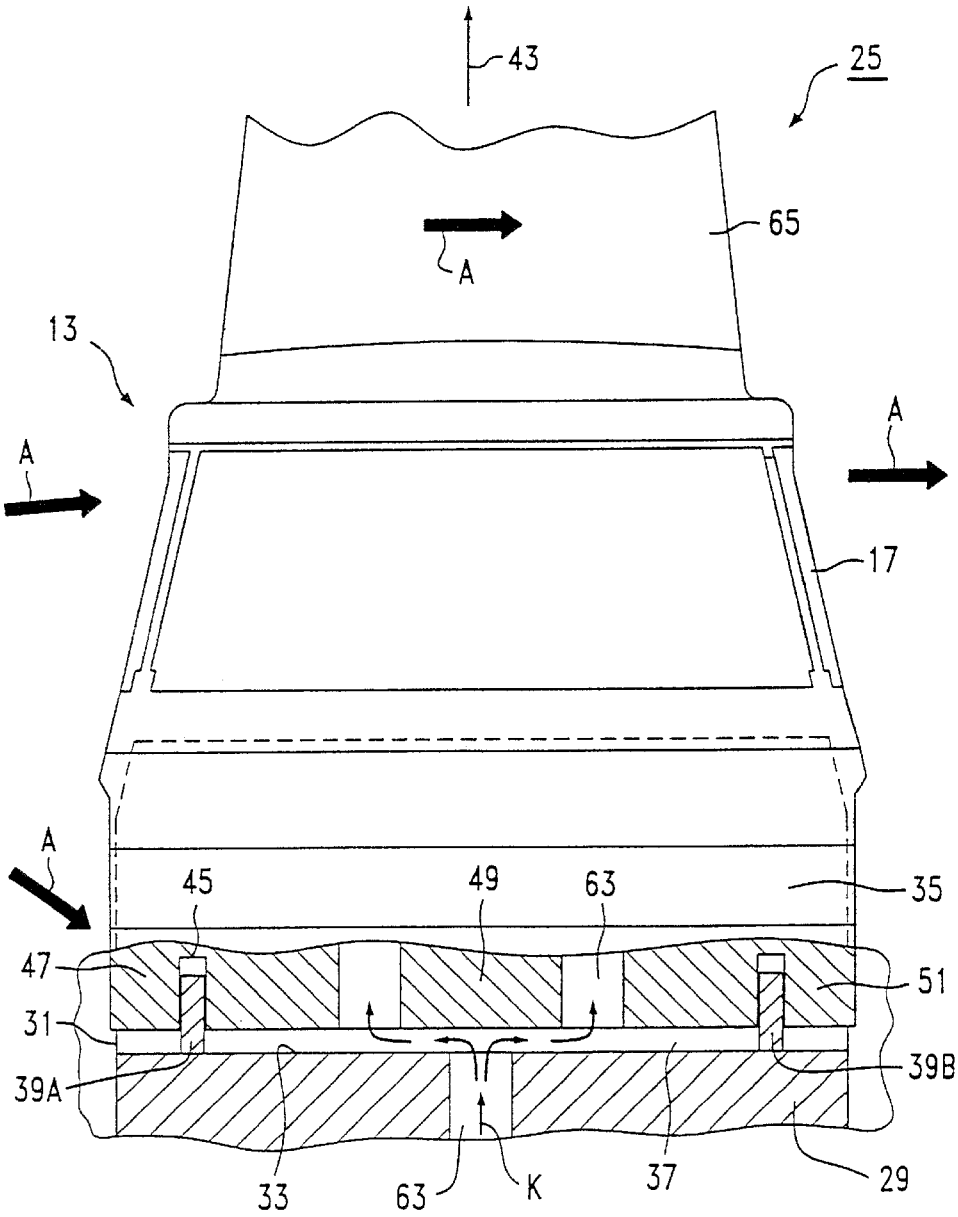
FIG. 7 shows a side view of a moving blade with an internal cooling system and a sealing element.

The sealing element 39 having the paired arrangement of the sealing element sections 53A, 53B can be used for sealing in different ways. In order to illustrate this, FIG. 7 shows a side view of a moving blade 13 cooled in the interior and having a sealing element 39A and a further sealing element 39B. The moving blade 13 is inserted with its blade root 35 into the rotor-shaft slot 31 of the moving disk 29. The blade root 35 has a first blade-root margin 47 and a second blade-root margin 51 located opposite the first blade-root margin 47 along the rotation axis. A blade-root center region 49 is arranged axially between the first blade-root margin 47 and the second blade-root margin 51.

Relative to the direction of flow of the flowing hot gas A, the first blade-root margin 47 is arranged upstream and the second blade-root margin 51 is arranged downstream. Provided in the moving disk 29 and in the blade-root center region 49 are cooling-medium leadthroughs 63, which extend along the longitudinal axis 43 and are in fluidic connection with the intermediate space 37. The cooling-medium leadthroughs 63 are part of an internal cooling system (not shown in FIG. 7) for the moving blade 13. For the internal cooling of the moving blade 13, a cooling medium K, e.g. cooling air, flows through the cooling-medium leadthroughs 63 and is directed by the internal cooling system through the blade platform 17 and through the radially adjoining blade body 65 of the moving blade 13. In order to seal the gap 37 against an escape of cooling medium K, the first sealing element 39A is arranged in the region of the first blade-root margin 47 and the second sealing element 39B is arranged in the region of the second blade-root margin 51. The sealing elements 39A, 39B are each arranged in a recess 45, in particular in a slot, in the blade root. In the process, the sealing elements 39A, 39B are partly accommodated by the blade root 35.

As described in FIGS. 4 to 6, but not shown in FIG. 7 for the sake of clarity, the sealing elements 39A, 39B are each configured as a system consisting of two sealing element sections 53A, 53B arranged in pairs (compare, for example, FIG. 5). During operation of the rotor 25, i.e. under the effect of a centrifugal force directed radially outward along the longitudinal axis 43, the sealing element sections 53A, 53B then come into contact with the slot root surface 33 and seal the gap 37. In the process, the sealing element 39A seals the gap at the first blade-root margin 47, and the sealing element 39B seals the gap at the second blade-root margin 51 arranged downstream. This configuration offers a high degree of safety both against the ingress of hot gas A into the gap 37 and against the escape of cooling medium K from the gap 37 into the flow passage 21 (cf. FIG. 7) of the rotor 25. An escape of cooling medium K into the flow passage 21 would lead, inter alia, to a reduction in the efficiency.

Figure 8:
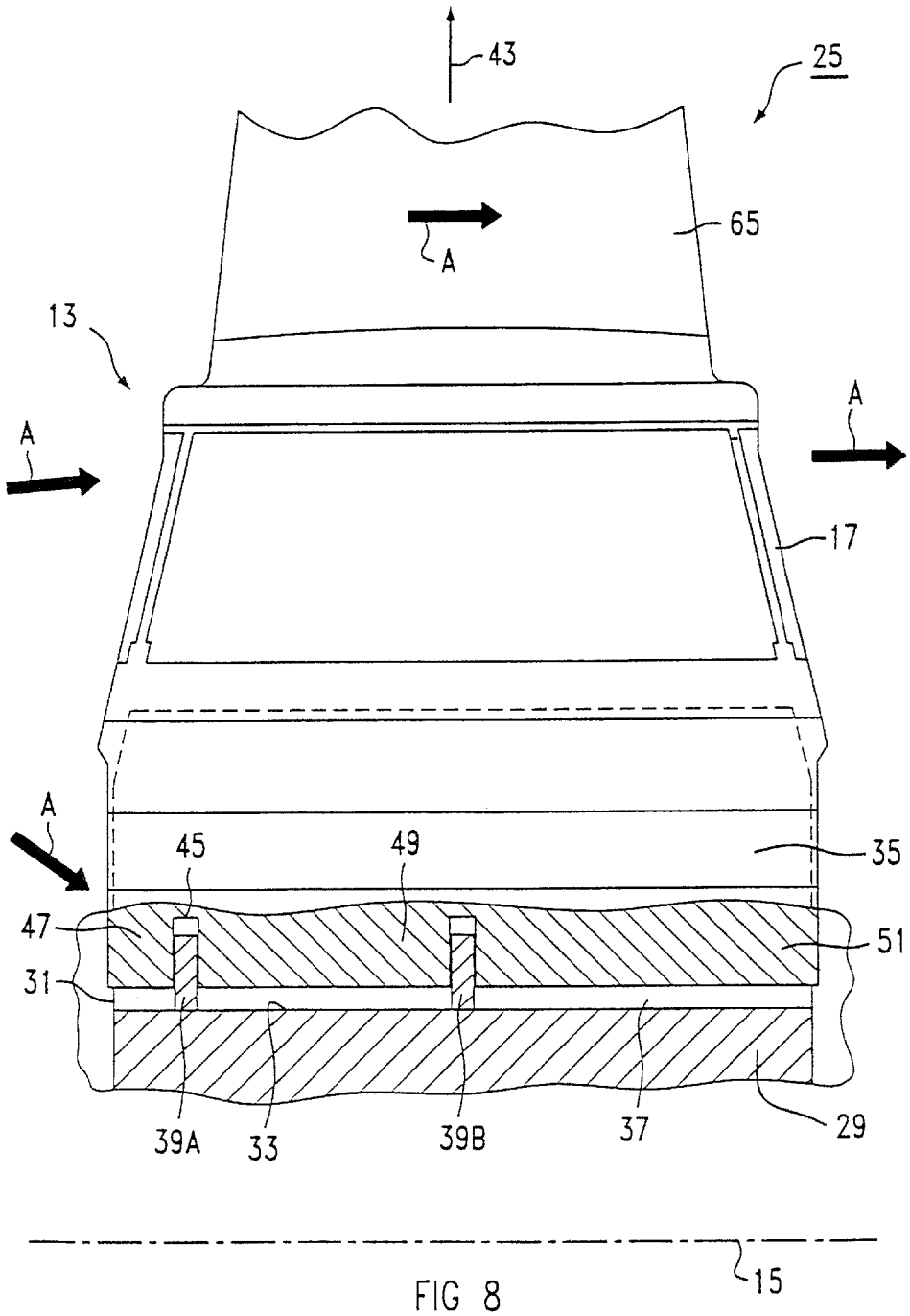
FIG. 8 shows a side view of a moving blade without an internal cooling system and with an alternative arrangement of a sealing element compared with FIG. 7.

FIG. 8 shows a side view of a moving blade 13 without an internal cooling system and having an alternative arrangement, compared with FIG. 7, of a sealing element 39A and of a further sealing element 39B. In this case, the sealing element 39A is arranged in the region of the first blade-root margin 47, and the sealing element 39B is arranged in the region of the blade-root center region 49. The arrangement of the sealing element 39A primarily limits the ingress of flowing hot gas A into the gap 37 and therefore prevents damage to the rotor 25. A correspondingly greater sealing effect is achieved by the combination of the sealing element 39A and the further sealing element 39B. The sealing concept specified offers very high flexibility with regard to the adaptation to an actual task definition. In this case, a multiple arrangement of sealing elements 39A, 39B is especially advantageous.

In addition to the fastening of a moving blade 13 in an essentially axially directed rotor-shaft slot 31 of a moving disk 29 (axial slot), other moving-blade fastenings are also known. The use of the sealing element 39 shown-in alternative moving-blade fastenings is illustrated below in FIGS. 9 and 10.

Figure 9:
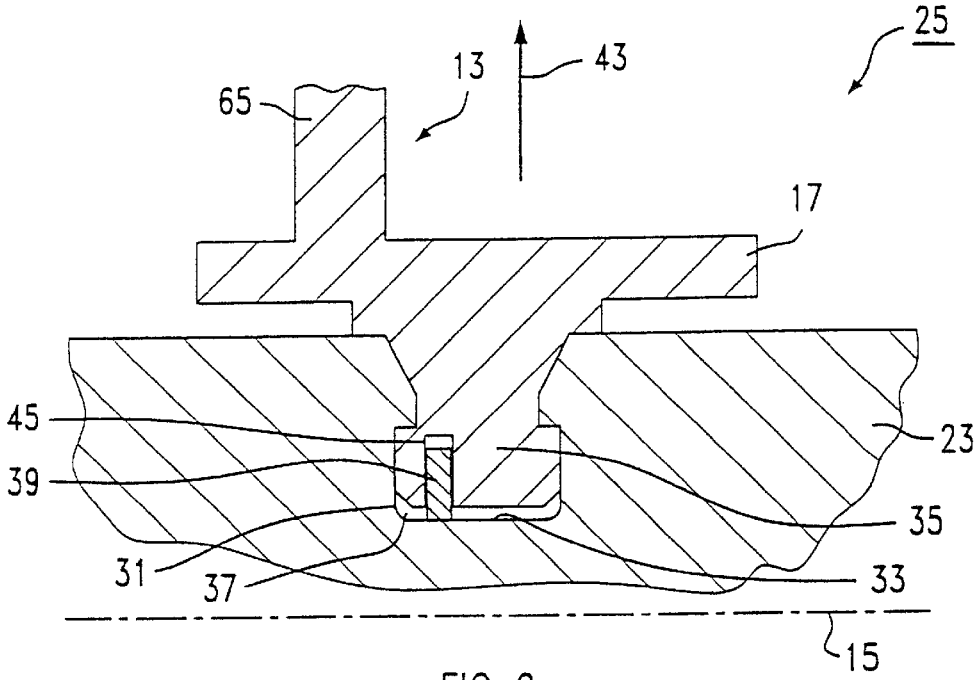
FIG. 9 shows a sectional view of a detail of a rotor with circumferential slot and inserted moving blade.

A sectional view of a detail of a rotor 25 with rotor-shaft slot 31 and with inserted moving blade 13 is shown in FIG. 9. In this case, the rotor-shaft slot 31 is designed as a circumferential slot 31 in the rotor shaft 23. The circumferential slot 31 is made as a "hammer-head slot" which accommodates the blade root 35. This form of blade fastening is preferably used for short moving blades 13 with low centrifugal forces and bending moments. Provided in the blade root 35 is a recess 45, in particular a slot, in which a sealing element 39 engages. The sealing element 39 extends in the circumferential direction of the rotor shaft 23 and seals the gap 37. In this case, the sealing element 39 seals the gap under the effect of centrifugal force and may be composed of two sealing element sections 53A, 53B (not shown in FIG. 9) overlapping in the circumferential direction and movable relative to one another, as described, for instance, with respect to FIG. 5. During rotation of the rotor shaft 23 about the rotation axis 15, the sealing element 39 is pressed firmly against the slot root surface 33 under the effect of centrifugal force. The gap 37 is sealed as a result.

Figure 10:
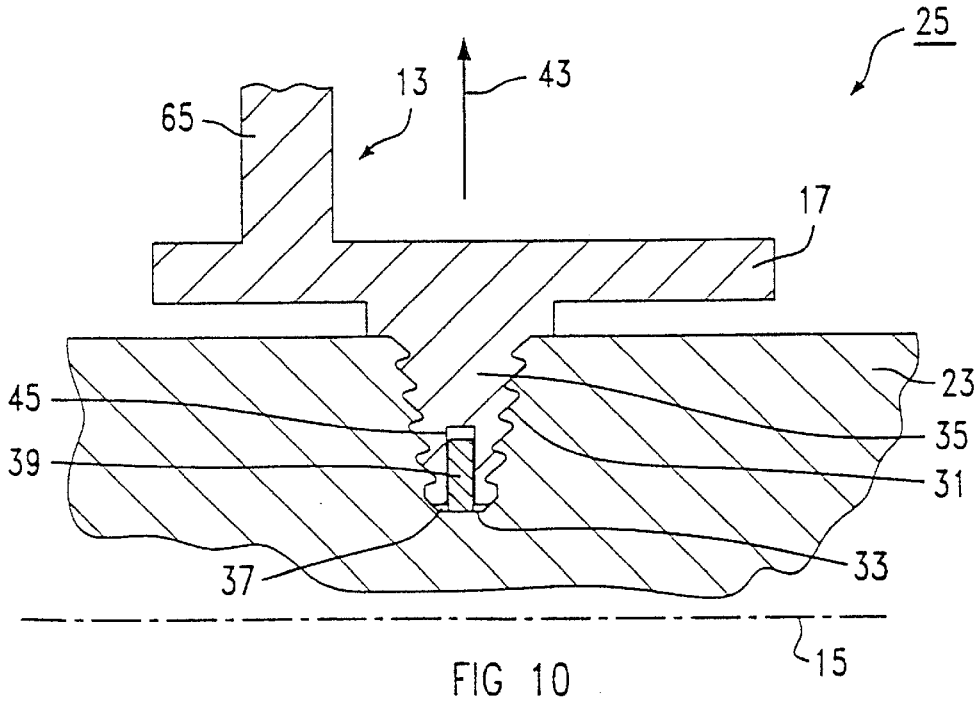
FIG. 10 shows a sectional view of a detail of a rotor with an alternative configuration of the moving-blade fastening compared with FIG. 9.

FIG. 10 shows a sectional view of a detail of a rotor 25 having an alternative configuration of the moving-blade fastening compared with FIG. 9. In this case, the circumferential slot 31 is produced by a "circumferential fir-tree slot". The blade root 35 of the moving blade 13 is accordingly produced as a fir-tree root, which engages in the circumferential slot 31, in particular in the circumferential fir-tree slot 31. By this type of fastening of the moving blade 13, very effective transmission of force to the rotor shaft 23 and especially reliable retention are achieved during rotation of the rotor 25 about the rotation axis 15. In a similar manner to FIG. 9, a recess 45, in which a sealing element 39 is arranged, is provided in the blade root 35. The sealing element 39 serves to seal the gap 37 which is formed between the blade root 35 and the slot root surface 33.

The concept specified for sealing the gap 37 by means of a sealing element 39, or respectively a pair of sealing element sections 53A, 53B movable relative to one another, can always also be applied in a very flexible manner to a rotor 25 whose moving blade 13 is fastened in a circumferential slot 31.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A fluid-flow machine comprising:

a rotor which extends along a rotation axis, including a rotor-shaft slot with a slot root surface and a moving blade with a blade root, the blade root being inserted into the rotor-shaft slot, wherein a gap is formed between the blade root and the slot root surface; and a sealing element, inserted in the gap, the sealing element being at least partly accommodated by the blade root, wherein the sealing element is movable relative to the blade root, and wherein the sealing element is adapted to rotate and relatively decrease the gap under the effect of centrifugal force, said sealing element comprises relatively movable portions.

2. The fluid-flow machine as claimed in claim 1, wherein the rotor includes a moving disk including the rotor-shaft slot with the slot root surface, the rotor-shaft slot extending along a transverse axis which is inclined relative to a plane perpendicular to the rotation axis.

3. The fluid-flow machine as claimed in claim 2, wherein the sealing element is arranged in a recess in the blade root.

4. The fluid-flow machine of claim 3, wherein the sealing element is arranged in a slot in the blade root.

5. The fluid-flow machine as claimed in claim 1, wherein the sealing element is arranged in a recess in the blade root.

6. The fluid-flow machine of claim 5, wherein the sealing element is arranged in a slot in the blade root.

7. The fluid-flow machine as claimed in claim 1, wherein the blade root includes a first blade-root margin and a second blade-root margin, located opposite the first blade-root margin along the rotation axis, and a blade-root center region arranged axially between the first blade-root margin and the second blade-root margin, a sealing element being arranged in at least one of the region of the first blade-root margin, of the second blade-root margin and of the blade-root center region.

8. The fluid-flow machine as claimed in claim 1, wherein a plurality of sealing elements are provided.

9. The fluid-flow machine as claimed in claim 1, wherein the sealing element extends in a plane perpendicular to the rotation axis.

10. The fluid-flow machine as claimed in claim 1, wherein the sealing element is movable in the radial direction.

11. The fluid-flow machine as claimed in claim 1, wherein the sealing element includes a first sealing element section and a second sealing element section which are movable relative to one another.

12. The fluid-flow machine as claimed in claim 11, wherein a first rotary region including a first rotary axis is assigned to the first sealing element section, and a second rotary region including a second rotary axis is assigned to the second sealing element section.

13. The fluid-flow machine as claimed in claim 12, wherein the mass center of the first sealing element section is arranged relative to the first rotary axis and the mass center of the second sealing element section is arranged relative to the second rotary axis, such that the torques resulting under the effect of centrifugal force are opposed.

14. The fluid-flow machine as claimed in claim 13, wherein the first sealing element section and the second sealing element section have similar geometry.

15. The fluid-flow machine as claimed in claim 13, wherein the first sealing element section and the second sealing element section overlap in the circumferential direction.

16. The fluid-flow machine as claimed in claim 13, wherein the first sealing element section and the second sealing element section are arranged axially adjacent to one another.

17. The fluid-flow machine as claimed in claim 12, wherein the first sealing element section and the second sealing element section have similar geometry.

18. The fluid-flow machine as claimed in claim 17, wherein the first sealing element section and the second sealing element section overlap in the circumferential direction.

19. The fluid-flow machine as claimed in claim 17, wherein the first sealing element section and the second sealing element section are arranged axially adjacent to one another.

20. The fluid-flow machine as claimed in claim 12, wherein the first sealing element section and the second sealing element section overlap in the circumferential direction.

21. The fluid-flow machine as claimed in claim 20, wherein the first sealing element section and the second sealing element section are arranged axially adjacent to one another.

22. The fluid-flow machine as claimed in claim 12, wherein the first sealing element section and the second sealing element section are arranged axially adjacent to one another.

23. The fluid-flow machine as claimed in claim 1, wherein the sealing element is made of a high-temperature-resistant material.

24. The fluid-flow machine of claim 23, wherein the sealing element is made of at least one of a nickel-base and cobalt-base alloy.

25. The fluid-flow machine as claimed in claim 1, wherein the fluid-flow machine is a gas turbine.

26. A sealing element comprising:

a first sealing element section and a second sealing element section, movable relative to one another and over lapping in a circumferential direction;

a first rotary region including a first rotary axis assigned to the first sealing element section; and a second rotary region including a second rotary axis assigned to the second sealing element section, wherein a mass center of the first sealing element section is arranged relative to the first rotary axis and a mass center of the second sealing element section is arranged relative to the second rotary axis in such a way that torques resulting on both sealing element sections under an effect of a force are opposed.

27. The sealing element as claimed in claim 26, wherein the first sealing element section and the second sealing element section have similar geometry.

* * * * *